US007184676B2

(12) United States Patent
Ota

(10) Patent No.: US 7,184,676 B2
(45) Date of Patent: Feb. 27, 2007

(54) CHARGING DEVICE AND IMAGE FORMING APPARATUS

(75) Inventor: Mitsuhiro Ota, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/463,448

(22) Filed: Jun. 18, 2003

(65) Prior Publication Data

US 2003/0235419 A1 Dec. 25, 2003

(30) Foreign Application Priority Data

Jun. 20, 2002 (JP) ..... 2002/179638

(51) Int. Cl.
*G03G 15/02* (2006.01)

(52) U.S. Cl. ..... 399/50

(58) Field of Classification Search ..... 399/50, 399/168, 174, 175, 176
See application file for complete search history.

(56) References Cited

U.S. PATENT DOCUMENTS 4,265,991 A 5/1981 Hirai et al. ..... 430/64
5,134,407 A 7/1992 Lorenz et al. ..... 399/174
5,457,522 A * 10/1995 Haneda et al. ..... 399/176
5,943,533 A * 8/1999 Ogata et al. ..... 399/168
6,134,407 A 10/2000 Ishiyama et al. ..... 399/174

FOREIGN PATENT DOCUMENTS

JP 60-35059 8/1985
JP 10-307454 11/1998
JP 10-307459 11/1998

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

A charging device including: a first charger which charges a member to be charged, the first charger having conducting particles which come into contact with the member to be charged; a second charger which charges the member to be charged in a same polarity as charging polarity of the first charger on an upstream side of the first charger in a moving direction of the member to be charged; and a controller which controls application of a charging voltage to the first charger, in which the controller turns a charging voltage on or off in an area of the member to be charged which is not subjected to charging by the second charger.

10 Claims, 4 Drawing Sheets

TIMING DIAGRAM OF CHARGE OPERATION

Δt : TIME REQUIRED FOR PHOTOSENSITIVE DRUM SURFACE, WHICH HAD BEEN IN CHARGING AREA "b" OF SUB-CHARGING MEANS 3, REACHING CHARGING AREA "a" OF MAIN-CHARGING MEANS 2

CHARGING DEVICE AND IMAGE FORMING APPARATUS

BACKGROUND OF THE INVENTION

1. Field of the Invention

The present invention relates to an image forming apparatus such as a copier or printer using an electrophotographic process, and a charging device which is preferably used for the image forming apparatus.

2. Related Background Art

In an image forming apparatus using an electrophotographic process, a photosensitive member is charged uniformly by charging means prior to an image exposure process.

In recent years, as a charging system of the charging means, a charge injection system has been contrived in which a discharge phenomenon is not substantially involved.

The charge injection system is a system in which a surface of a photosensitive member is charged as charges are injected directly into the photosensitive member from a contact charging member. In the charge injection system, a medium-resistance contact charging member comes into contact with the surface of the photosensitive member to directly inject charges into the surface of the photosensitive member not through a discharge phenomenon. In other words, the discharge is not generally used, and the charge injection is directly performed on the photosensitive member surface. Since the discharge phenomenon is not used, a voltage required for the charging is only that for a desired photosensitive member surface potential, and further, ozone is not generated. Thus, this is an ozone-less low-power charging system. In addition, in order to directly inject charges, a surface potential is equivalent to an applied voltage, and a charge start voltage Vth does not appear. Consequently, even in the case in which a DC voltage is applied, stable charging which is not affected by variation of environment such as humidity can be realized.

On the other hand, a probability of contact between the charging member and the surface of the photosensitive member influences charging ability due to a characteristic that charges are injected only into an area where the charging member comes into contact with the surface of the photosensitive member. In the case in which the probability of contact is insufficient and a large portion of the surface is not charged, charging ends before the photosensitive member surface potential reaches the voltage applied to the charging member.

In a magnetic brush charging device, or a contact charging device using nonmagnetic conducting particles described, for example, in JP 10-307454 A to 10-307459 A, a high probability of contact between a contact charging member and a surface of a photosensitive member is obtained uniformly, and a direct charge injection mechanism is predominantly employed.

In general, the magnetic brush charging device magnetically constrains conducting magnetic particles on a surface of a sleeve containing a magnet roller and rotates the sleeve, thereby performing charging while increasing a probability of contact between the sleeve and the surface of the photosensitive member.

The contact charging device using nonmagnetic conducting particles deposits conductive particulates on a sponge roller formed of a conductive sponge or the like and causes particles to intervene between the sponge roller and the surface of the photosensitive member, thereby making it possible to reduce a frictional resistance between the sponge roller and the surface of the photosensitive member and provide a difference of velocities between the sponge roller and the photosensitive member. Thus, a probability of contact between the sponge roller and the photosensitive member is improved through the difference of velocities and the intervention of the particles.

In this way, in the charge injection system, in order to eliminate contact failure between conducting particles and a member to be charged to obtain a sufficient chance of contact, it is preferable to bring the conducting particles and the member to be charged into contact with each other to prevent generation of a gap.

However, in the case in which the conducting particles are used, the conducting particles may deposit on the member to be charged and fall from the charging device.

In addition, in order to prevent charge injection ability from becoming insufficient due to speed-up of operations in the image forming apparatus, it is also considered to perform preliminary charging with a preliminary charger prior to charging with an injection charger.

If the preliminary charging is performed in this way, the fall of conducting particles becomes conspicuous, the conducting particles become insufficient, and charging failure may occur due to insufficient chance of contact.

SUMMARY OF THE INVENTION

It is an object of the present invention to provide a charging device provided with a preliminary charger and a main charger, and an image forming apparatus including the charging device.

It is another object of the present invention to provide a charging device which restrains fall of conducting particles from a charger as much as possible, and an image forming apparatus including the charging device.

Further objects of the present invention will become apparent from the following description.

DESCRIPTION OF THE PREFERRED EMBODIMENTS

Embodiments of the present invention will be hereinafter described with reference to the accompanying drawings.

(First embodiment)

Figure 1:
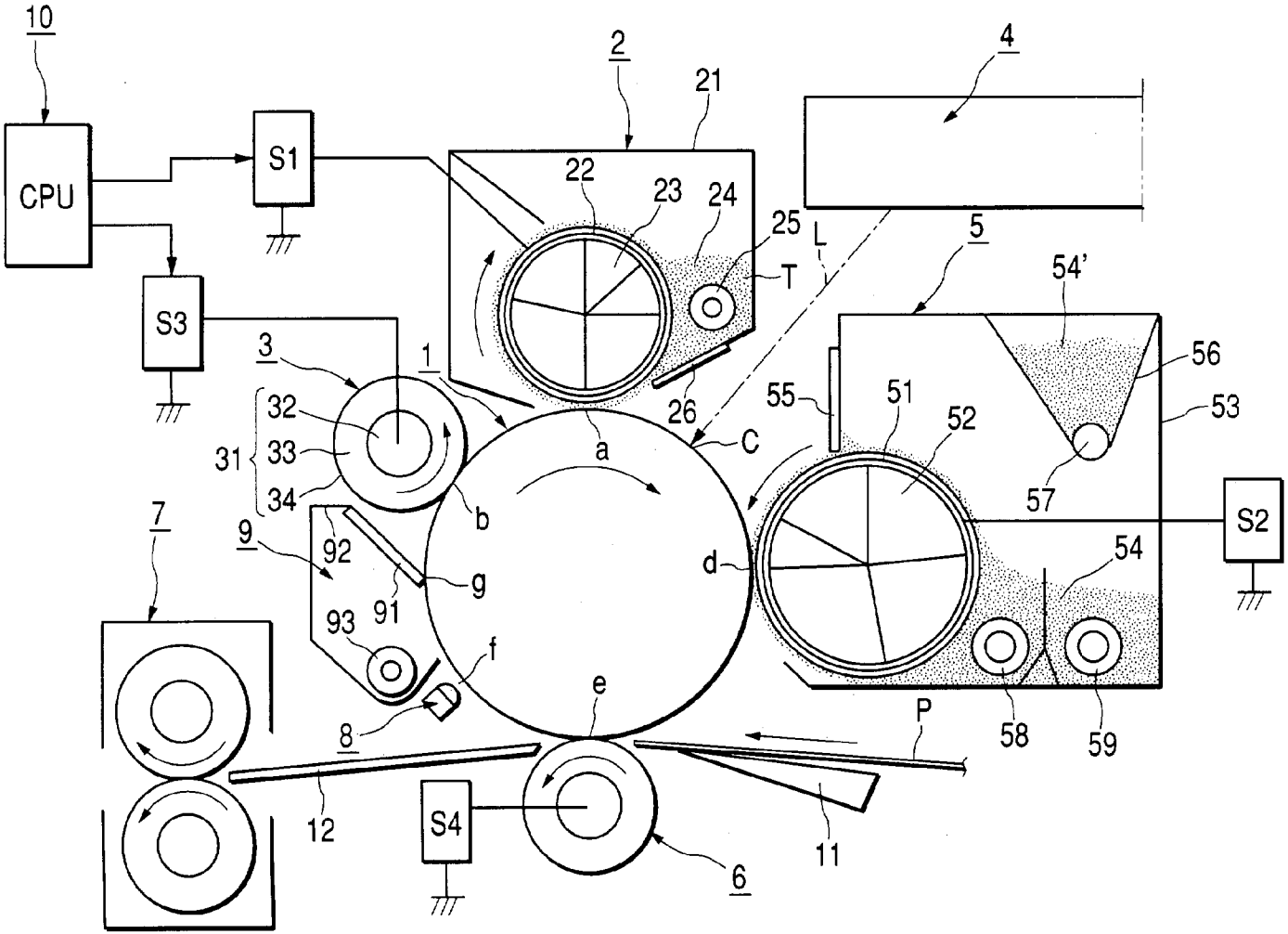
FIG. 1 is a schematic diagram of an image forming apparatus in a first embodiment.

FIG. 1 is a schematic diagram of an image forming apparatus provided with a charging device in accordance with the present invention. The image forming apparatus of this embodiment is a laser beam printer using the transfer electrophotographic process.

(1) Overall Schematic Structure of the Printer

Figure 2:
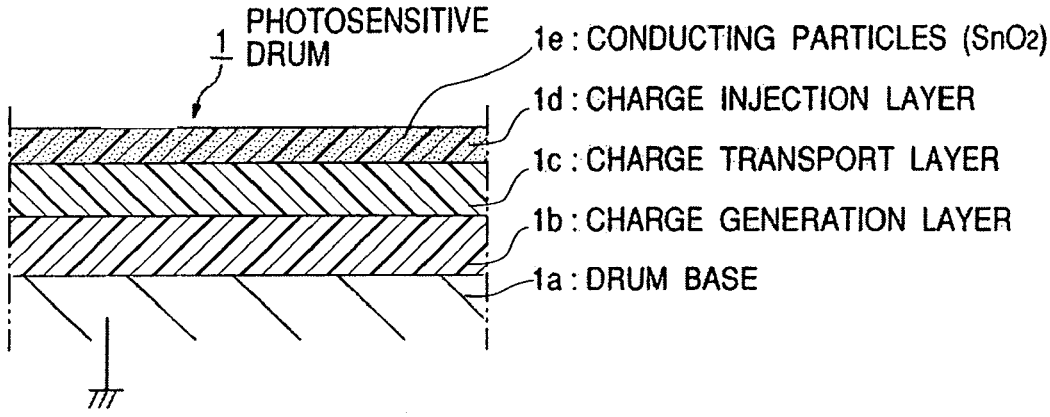
FIG. 2 is a layer diagram of a photosensitive drum.

Reference numeral 1 denotes an electrophotographic photosensitive member of a rotary drum type (hereinafter referred to as photosensitive drum) serving as an image bearing member (a member to be charged). As shown in FIG. 2, the photosensitive drum 1 in this embodiment includes an organic photoconductive layer formed on a drum base 1*a*. The layer includes a charge generation layer 1*b* formed by scattering a dis-azo based pigment in resin and a charge transport layer 1*c* formed by scattering hydrazone in polycarbonate resin, and further includes, as an upper most surface layer, a charge injection layer 1*d* formed by scattering $SnO_2$ of ultra-fine particles as conducting particles 1*e* in photo-hardening type acrylic resin. The photosensitive drum 1 is driven to rotate in a clockwise direction of the arrow at a peripheral velocity of 100 mm/sec.

Reference numeral 2 denotes main-charging means, which is a magnetic brush charging device in this embodiment. Reference symbol S1 denotes a charging bias application power supply for charging bias to this magnetic brush charging device 2. A surface of the rotating photosensitive drum 1 is subjected to contact charging treatment with direct charge injection mechanism to be charged uniformly to predetermined polarity and potential, in this embodiment, to substantially −600V by this magnetic brush charging device 2 in a charging area "a". This magnetic brush charging device 2 will be described in detail in section (2) later.

Reference numeral 3 denotes sub-charging means, which is a contact roller charging device in this embodiment. Reference numeral 31 denotes an auxiliary charging roller serving as a contact charging member of this roller charging device 3. The auxiliary charging roller 31 is disposed in contact with the photosensitive drum 1 on a further upstream side in a rotating direction of the photosensitive drum 1 than a magnetic brush charging device 2 serving as main-charging means, and rotates following the rotation of the photosensitive drum 1. Reference symbol S3 denotes a charging bias application power supply for charging bias to this roller charging device 3, and applies a voltage of the same polarity as the magnetic brush charging device 2 serving as main-charging means. A surface of the rotating photosensitive drum 1 is subjected to contact charging treatment to be charged uniformly to predetermined polarity and potential, in this embodiment, to a negative predetermined potential by this roller charging device 3 in a charging area "b". That is, the photosensitive drum 1 is charged to negative polarity in advance by the auxiliary charging roller 31 of the roller charging device 3 serving as the sub-charging means and, then, charged to negative polarity again by the magnetic brush charging device 2 serving as the main-charging means. This roller charging device 3 will be described in detail in section (3) later.

Reference numeral 4 denotes image exposure means serving as information writing means, which is a laser beam scanner in this embodiment. This laser beam scanner 4 outputs a laser L with an emitted light wavelength of 680 nm, which is ON/OFF modulated in association with an image signal, and scans and exposes the surface of the rotary photosensitive drum. 1, which has been charged uniformly by the magnetic brush charging device 2 serving as the main-charging means, in an exposure part "c".

A potential in an exposed bright section (area where a laser beam was irradiated) of the surface of the uniformly charged photosensitive drum 1 decays due to this laser beam scan exposure, and an electrostatic latent image corresponding to a scan exposure pattern is formed according to an electrostatic contrast between the potential and a potential of an exposed dark section.

Reference numeral 5 denotes a developing device, which develops the electrostatic latent image formed as described above on the surface of the photosensitive drum 1 as a toner image. The developing device 5 in this embodiment is a reversal developing device, which uses a toner of negative charging property and deposits this toner on the exposed bright section of the electrostatic latent image to subject the electrostatic image to reversal development and form a toner image.

This developing device 5 is provided with a rotating developing sleeve 51 containing a fixed magnet roll 52. A developer 54 in a developing container 53 is coated on the developing sleeve 51 by a blade 55 and carried to a development section "d". The developing sleeve 51 is driven by a not-shown motor to rotate in a counterclockwise direction of arrow at a peripheral velocity of 150 mm/sec. The developer 54 is a two component developer, in which a toner of negative charging property with an average particle diameter of 8 μm and a magnetic carrier of positive charging property with an average particle diameter of 50 μm are mixed at a weight toner density of 5%. The toner density is controlled by a not-shown optical toner density sensor. A supply toner 54' in a toner hopper 56 is supplied by a supply roller 57. The developer 54 in the developing container 53 is agitated uniformly by agitating members 58 and 59. A development bias, in which a DC voltage Vde of −500 V is superimposed on an alternating electric field of 2 kvpp, 2 kHz, is applied to the developing sleeve 51 from a development bias application power supply S2. The developer, which was coasted in a thin layer on the developing sleeve 51 and carried to the development section "d", is used to subject the electrostatic latent image on the photosensitive drum 1 to reversal development with an electric field, which is generated by the development bias voltage of AC+DC, to form a toner image.

Reference numeral 6 denotes a conductive elastic transfer roller serving as a contact transfer device, which is brought into pressed contact with the photosensitive drum 1 with a predetermined pressing force to form a transfer nip section "e". Reference symbol S4 is a transfer bias application power supply, which applies a DC bias of polarity opposite to the charging polarity of the toner, in this embodiment, a predetermined positive voltage, to the transfer roller 6. Transfer materials P as recording mediums (receptors) are fed from a not-shown sheet feed mechanism section at predetermined control timing and guided into the transfer nip section "e" by a guide 11. The toner image formed on the surface of the photosensitive drum 1 is sequentially electrostatically transferred onto the surfaces of the transfer materials P in a process in which the transfer materials P are nipped and conveyed in the transfer nip section "e".

The transfer materials P conveyed through the transfer nip section "e" are separated from the surface of the photosensitive drum 1, guided into a fixing device 7 by a guide 12 to be subjected to heat fixing treatment of the toner image, and delivered as an image formed object (print, copy).

On the other hand, the surface of the photosensitive drum after separating the transfer materials is subjected to entire surface exposure treatment with a center wavelength of 660 nm and an amount of light of 8 1×·s by a residual charge eliminating electric lamp 8 in a position "f" to have charges eliminated from the surface. Subsequently, the surface of the photosensitive drum is subjected to removal treatment of a transfer residual toner by a cleaning device 9 to be cleaned and served for image formation repeatedly.

The cleaning device 9 in this embodiment is a cleaning blade abutting type. Reference symbol "g" denotes an edge abutting section where a cleaning blade 91 abuts against the photosensitive drum 1. The cleaning blade 91 is made of silicon denatured polyurethane rubber and is adhered to a support plate 92. A toner removed from the photosensitive drum 1 by the cleaning blade 91 is carried to a not-shown waste toner container by a screw 93 and collected.

Reference numeral 10 denotes a control circuit section (control means) of the printer, which manages sequence control of the entire printer.

(2) Magnetic Brush Charging Device 2

In the magnetic brush charging device 2 serving as main-charging means, reference numeral 21 denotes a device housing. In this device housing 21, a charging sleeve 22 and a particle agitation screw 25 are disposed. In addition, conducting magnetic particles 24 serving as conducting particles are contained in the same. Reference numeral 26 denotes a particle regulating blade which is disposed in a downward opening section of the device housing 21. A lower surface of the charging sleeve 22 is placed to face the downward opening section of the device housing 21. The magnetic brush charging device 2 is disposed against the photosensitive drum 1 with the lower surface of this charging sleeve 22 opposed to the upper surface of the photosensitive drum 1 with a space of 500 μm.

The charging sleeve 22 is a nonmagnetic conductive sleeve with a diameter of 16 mm and is driven to rotate in a clockwise direction of arrow at a peripheral velocity of 150 mm/sec by a not-shown drive system. A magnet roller 23 is inserted and disposed in this charging sleeve 22. This magnet roller 23 is a non-rotational fixed member and is formed in a repulsive pole structure having five magnetic peaks in a rotating direction of the charging sleeve 22, among which the adjacent magnetic peaks have the same polarity.

A total weight of the conducting magnetic particles 24 contained in the device housing 21 is 200 g. A reservoir section T of the conducting magnetic particles 24 is formed on an upstream side in the rotating direction of the charging sleeve of the particle regulating blade 26. The screw 25 agitates the conducting magnetic particles 24 of this reservoir section T in a meridian direction of the charging sleeve. The screw 25 is formed by attaching elliptical impellers in alternate directions and can agitate the conducting magnetic particles 24 in the reservoir section T without moving them to one side. Further, all the conducting magnetic particles 24 in the reservoir section T are gently agitated according to an agitation effect of the screw 25 and the repulsive poles of the magnet roller 23.

A part of the conducting magnetic particles 24 in the reservoir section T is held as a magnetic brush layer on the charging sleeve 22 by a magnetic restricting force generated by the magnet roller 23. The part of the conducting magnetic particles 24 is carried following the rotation of the charging sleeve 22 and is regulated to a predetermined layer thickness by the particle regulating blade 26.

A magnetic brush layer of the conducting magnetic particle 24, whose layer thickness has been regulated by the particle regulating blade 26, is carried to a nip section between the charging sleeve 22 and the photosensitive drum 1 opposed to each other according to the following rotation of the charging sleeve 22, and brought into contact with the surface of the photosensitive drum 1. Then, the magnetic brush layer passes the nip section between the charging sleeve 22 and the photosensitive drum 1 opposed to each other while rubbing the surface of the photosensitive drum 1. A section of this magnetic brush layer, which is in contact with and rubs the surface of the photosensitive drum, is a charging area "a". A density of a magnetic flux generated by the magnet roll 23 on the charging sleeve 22 in the charging area "a" is $950\times10^{-4}$ T. The magnetic brush layer of the conducting magnetic particles 24, which has passed the nip section between the charging sleeve 22 and the photosensitive drum 1 opposed to each other, is returned to the reservoir section T in the device housing 21 according to the following rotation of the charging sleeve 22 and is used in a circulating manner.

In the charging area "a", the photosensitive drum 1 and the charging sleeve 22 rotate in opposite directions and have a difference of peripheral velocities. Consequently, in the charging area "a", the surface of the photosensitive drum 1 is rubbed evenly by the magnetic brush layer of the conducting magnetic particles 24 which is carried following the rotation of the charging sleeve 22.

Then, a charging bias, in which a DC voltage Vch of −600 V is superimposed on an alternating electric field of 500 Vpp, 1 kHz in the case of this embodiment, is applied to the charging sleeve 31 from a power supply S1.

Consequently, the surface of the rotating photosensitive drum 1 is subjected to contact charging treatment with the direct charge injection mechanism to be charged uniformly to −600 V in the charging area "a" by the magnetic brush charging device 2.

If a rotation peripheral velocity of the charging sleeve 22 is too low, the probability of contact between the surface of the photosensitive drum 1 and the conducting magnetic particles 24 becomes insufficient, which becomes a cause of image failure such as charging unevenness. If the rotation peripheral velocity is too high, scattering of the conducting magnetic particles 24 is caused. As a peripheral velocity of the charging sleeve 22 in this embodiment, a peripheral velocity with which satisfactory charging can be performed is preferably 50 to 250 mm/sec, although it depends upon an external diameter of the charging sleeve 22 or a space between the charging sleeve 22 and the photosensitive drum 1.

For example, the following magnetic particles are used preferably as the conducting magnetic particles 24:

(i) Magnetic particles formed by mixing resin and magnetic powder of magnetite or the like and casting the mixture as particles, or particles with conducting carbon or the like mixed therein for adjustment of a resistance value;

(ii) Magnetic particles of sintered magnetite or ferrite, or magnetic particles formed by subjecting it to reduction or oxidation treatment to adjust a resistance value thereof;

(iii) Magnetic particles formed by coating the above-mentioned magnetic particles with a coating material (phenol resin in which carbon is scattered, etc.) with a resistance thereof adjusted or subjecting them to plating treatment with metal such as Ni to have an appropriate resistance value.

As to a resistance value of these conducting magnetic particles 24, if it is too high, charges cannot be injected uniformly in the photosensitive drum 1 and a fogged image due to very small charging failure is formed. If it is too low, when there is a pinhole on the surface of the photosensitive drum 1, electric currents concentrate on the pinhole and a charging voltage falls. Thus, the surface of the photosensitive drum 1 cannot be charged, and charging failure of a charging nip shape is caused. Therefore, $1\times10^4$ to $1\times10^7$ Ω is desirable as the resistance value of the conducting magnetic particles 24.

As a magnetic characteristic of the conducting magnetic particles 24, it is preferable to increase a magnetic restricting force in order to prevent deposition of the conducting magnetic particles 24 on the photosensitive drum 1, and saturation magnetization is desirably 50 ($A\cdot m^2/kg$) and above.

Actually, the conducting magnetic particles 24 used in this embodiment had a volume average particle diameter of 30 μm, an apparent density of 2.0 $g/cm^3$, a resistance value of $1\times10^6$ Ω, and a saturation magnetization of 58 $A\cdot m^2/kg$. In addition, a particle diameter of the conducting magnetic particles 24 affects a charging ability and uniformity of charging. That is, if the particle diameter is too large, a ratio of contact with the photosensitive drum 1 falls, which becomes a cause of charging unevenness. If the particle diameter is small, both the charging ability and the uniformity of charging improve but, on the other hand, magnetic force acting on one particle falls, and deposition of the conducting magnetic particles 24 tend to take place on the photosensitive drum 1. Consequently, the particle diameter of the conducting magnetic particles is preferably 5 to 100 μm. Triboelectrification of the conducting magnetic particles is plus which is opposite to charging polarity.

(3) Roller Charging Device 3

The auxiliary charging roller 31 serving as the contact charging member of the roller charging device 3 serving as the sub-charging means is formed as a roller with a diameter of 12 mm having an elastic layer 33 and a surface layer 34 serving as a resistance control member by forming an EPDM layer 33 in which carbon black with a thickness of 3 mm is scattered on a stainless core metal 32 with a diameter of 6 mm, forming a film layer 34 with a dipping method, and heating to dry the layers for thirty minutes at 150° C.

Both ends of the core metal 32 of this auxiliary charging roller 31 are biased toward the photosensitive drum 1 by a biasing member (not shown), and the auxiliary charging roller 31 is in pressed contact with the surface of the photosensitive drum 1 with a predetermined pressing force to form a charging nip section of a belt shape in-between. This charging nip section is a charging area "b". The auxiliary charging roller 31 does not have a drive mechanism and rotates in a counterclockwise direction of arrow following the rotation of the photosensitive drum 1. A DC voltage of −1.2 kV is applied to the core metal 32 from the power supply S3.

A material for the elastic layer 33 of the auxiliary charging roller 31 is not limited to the above. Urethane, SBR, EVA, SBS, SEBS, SIS, TPO, EPM, NBR, IR, BR, silicon rubber, epichlorohydrin rubber, or the like may be used. In addition, depending upon a necessary resistance value, a solid electrolyte such as carbon black, carbon fiber, metal oxide, metal powder, or hydrogen peroxide salt or a conductivity imparting agent such as surfactant may be added thereto.

As a material of the surface layer 34 serving as the resistance control member, for example, polyamide, polyurethane, fluorine, polyvinyl alcohol, silicon, NBR, EPDM, CR, IR, BR, or resin or rubber such as hydrin rubber may be used. In addition, for example, a conductive or insulating filler or additive may be mixed therein. The materials described above are used to bring an electric resistance value of the charging member to $1\times10^3$ to $1\times10^{10}$. However, any combination of the above-mentioned materials may be adopted as long as this value is obtained finally. An electric resistance value of the roller of this embodiment was $1\times10^8$.

(4) Control of Timing for Starting and Ending Charging of Main-Charging Means 2 and Sub-Charging Means 3

Figure 3:
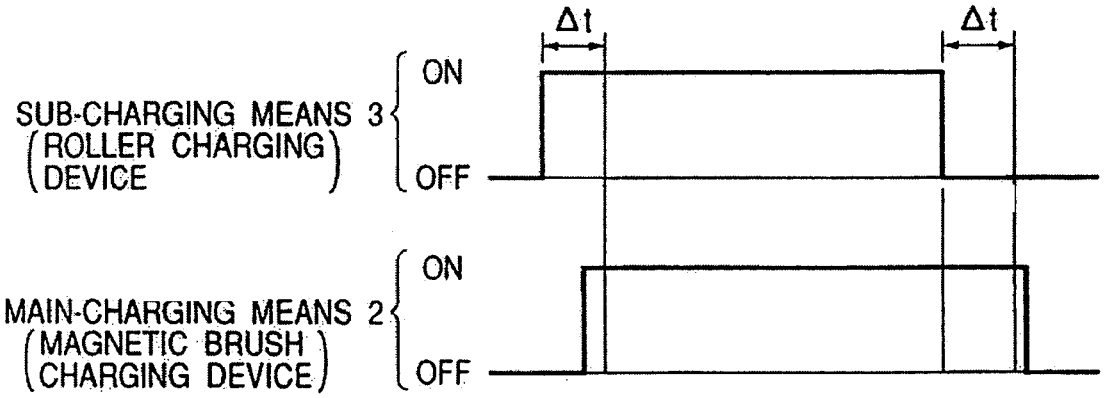
FIG. 3 is a time diagram of a charging operation of main-charging means and sub-charging means.

FIG. 3 shows a timing diagram for starting and ending charging of the magnetic brush charging device 2 serving as the main-charging means and the roller charging device 3 serving as the sub-charging means. This timing control is performed as the charging bias application power supply S1 for the magnetic brush charging device 2 and the charging bias application power supply S3 for the roller charging device 3 are subjected to ON-OFF sequence control in a predetermined manner by a control circuit 10.

That is, after charging by the roller charging device 3 serving as the sub-charging means is started, charging by the magnetic brush charging device 2 is started before the surface of the photosensitive drum 1, which has been in the charging area "b" of this roller charging device 3, reaches the charging area "a" of the magnetic brush charging device 2 serving as the main-charging means.

Conversely, in the case of ending the operation, after the charging by the roller charging device 3 is ended, the charging by the magnetic brush charging device 2 is ended after the surface of the photosensitive drum 1, which has been in the charging area "b" of this roller charging device 3, passes the charging area "a" of the magnetic brush charging area 2.

As a result, the surface of the photosensitive drum 1 charged only by-the roller charging device 3 serving as the sub-charging means and the conducting magnetic particles 24 in a state in which a voltage is not applied thereto in the magnetic brush charging device 2 serving as the main-charging means do not come into contact with each other.

In a state in which conducting particles, to which a charging voltage is not applied, are in contact with a surface of a photosensitive member which is charged in negative polarity by the sub-charging means, a force in a direction toward the photosensitive member acts on conducting magnetic particles, which is charged in positive polarity by triboelectrification, according to an action of an electric field.

Therefore, magnetic particles deposit on the surface of the photosensitive member and are carried.

In this embodiment, since ON/OFF of charging by a main charger is applied to the surface of the photosensitive member which is not subjected to charging by a sub-charger, the main charger is in a state in which a charging voltage is applied to the surface of the photosensitive member subjected to the charging by the sub-charger.

Consequently, generation of an electric field, which applies the force acting toward the photosensitive member to the conducting particles, can be prevented, and the conducting particles can be prevented from being carried to the surface of the photosensitive member.

In addition, it is unnecessary to fix a value of a voltage to be applied to the roller charger device 3 serving as the sub-charging means and, for example, the voltage may be variable depending upon change in a resistance caused by contamination or deterioration due to energization of the auxiliary charging roller 31. Further, it is also possible to perform more stable charging by applying an AC voltage twice or more as large as a discharge threshold value.

If the above-mentioned structure is used, the conducting magnetic particles in the magnetic brush charging device 2 serving as the main-charging means can be prevented from depositing on the photosensitive drum 1 over the entire surface of the charging area.

Note that, although the roller charging device is used as the sub-charging means 3 in this embodiment, the present invention is not limited to this. For example, the same effect can be obtained by a general corona charger, a fur brush charging device in which a conductive brush is brought into contact with a photosensitive drum, or magnetic brush charging device. The sub-charging means 3 may be provided in a plural form. This is also applicable to the main-charging means.

(Second Embodiment)

Figure 4:
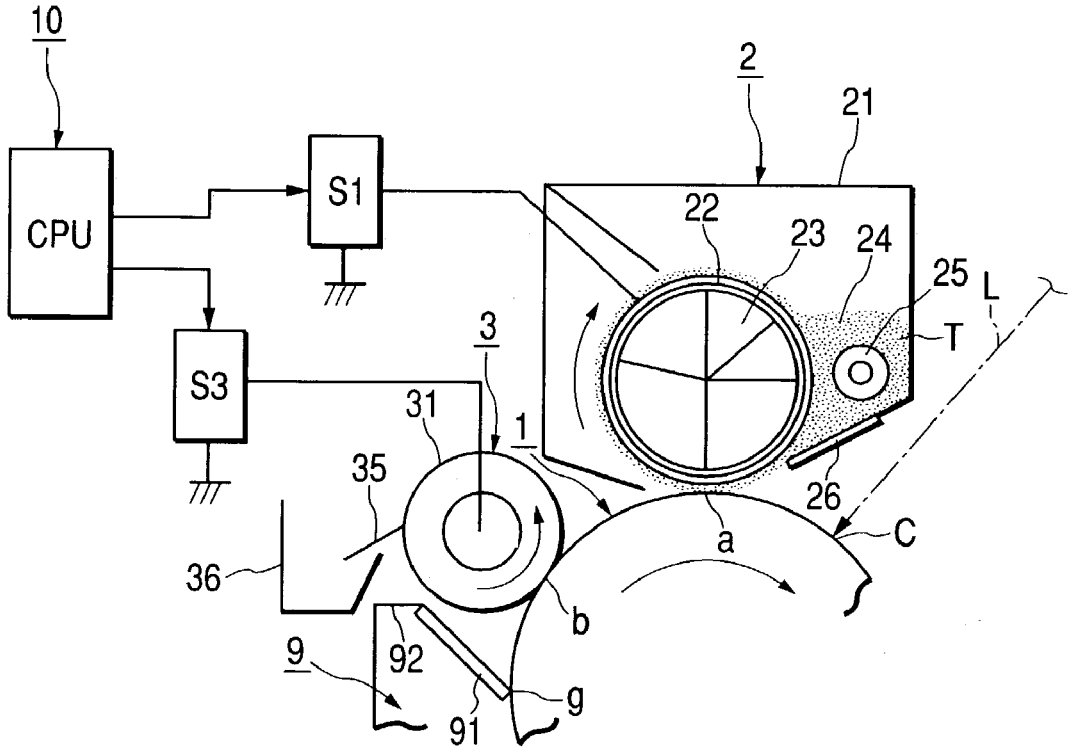
FIG. 4 is a schematic diagram of a main part of an image forming apparatus of a second embodiment.

This embodiment is characterized in that, in the printer of the first embodiment, cleaning members 35 and 36 are provided in the auxiliary charging roller 31 serving as the contact charging member of the roller charging device 3 serving as the sub-charging means as shown in FIG. 4. Since the other components of the printer are the same as those in the printer of the first embodiment, repeated description of the components will be omitted.

There is a problem in that particulates of a toner extraneous additive, which has passed through the cleaning blade 91 of the cleaning device 9, deposit on the auxiliary charging roller 31, whereby a resistance on a surface layer of the roller increases, a discharge threshold value (charge start voltage) Vth of contact charging changes, and a charging voltage fluctuates. Thus, in this embodiment, a scraper 35 formed by a PET material is abutted against the auxiliary charging roller 31 over substantially the entire area thereof to remove deposits on the surface of the auxiliary charging roller 31. The removed deposits are contained in a container 36.

According to the above-mentioned structure, the surface of the auxiliary charging roller 31 is always maintained in a state without deposits, and satisfactory charging can be performed over a long period. As a result, an electric field which is generated between the auxiliary charging roller 31 and the photosensitive drum 1 can be kept constant and, in the magnetic brush charging device 2 serving as the main-charging means, the conducting magnetic particles on the entire surface of the charging area can be prevented from depositing on the photosensitive drum 1 over a long period.

(Third Embodiment)

Figure 5:
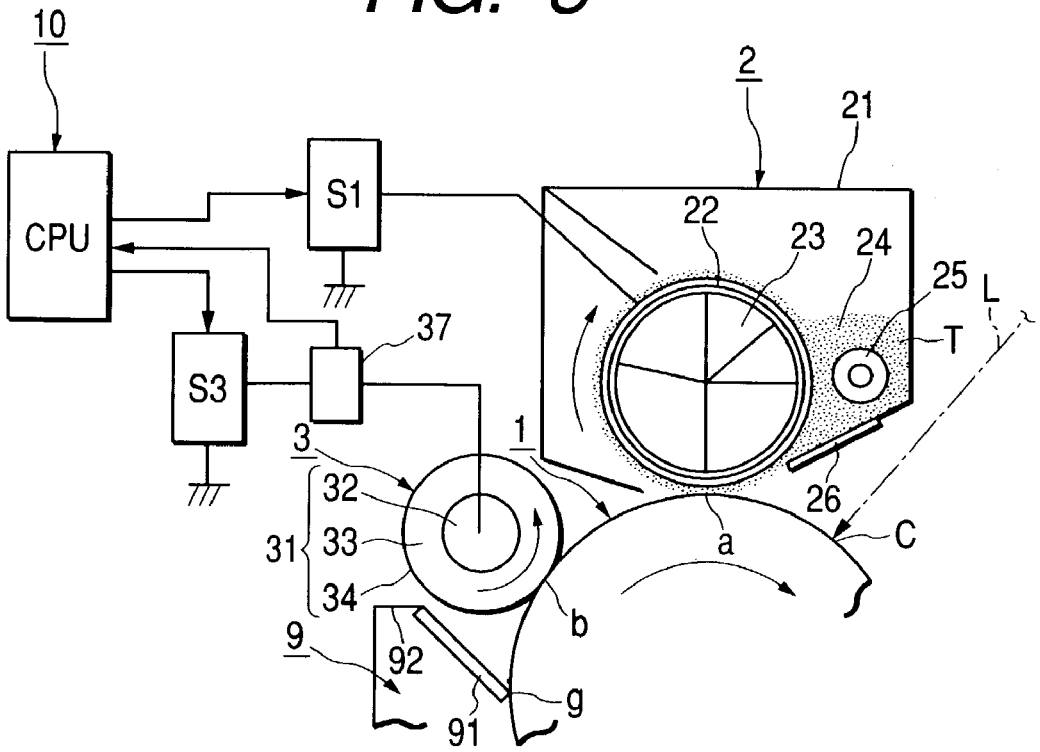
FIG. 5 is a schematic diagram of a main part of an image forming apparatus of a third embodiment.

This embodiment is characterized in that, in the printer of the first embodiment, a charging bias to be applied to the auxiliary charging roller 31 serving as the contact charging member of the roller charging device 3 serving as the sub-charging means is controlled, whereby the conducting magnetic particles is prevented from depositing on the photosensitive drum 1 in the magnetic brush charging device 2 serving as the main-charging means. FIG. 5 is a diagram of this embodiment. In the figure, reference numeral 37 denotes a current detector, which detects an amount of an electric current flowing from the power supply S3 to the auxiliary charging roller 31. A result of the detection is fed back to the control circuit 10. The control circuit 10 controls the power supply S1 based upon the result of the detection to be inputted thereto, and controls an applied bias to the auxiliary charging roller 31 appropriately. Since the other components of the printer is the same as those in the printer of the first embodiment, repeated description of the components will be omitted.

Figure 6:
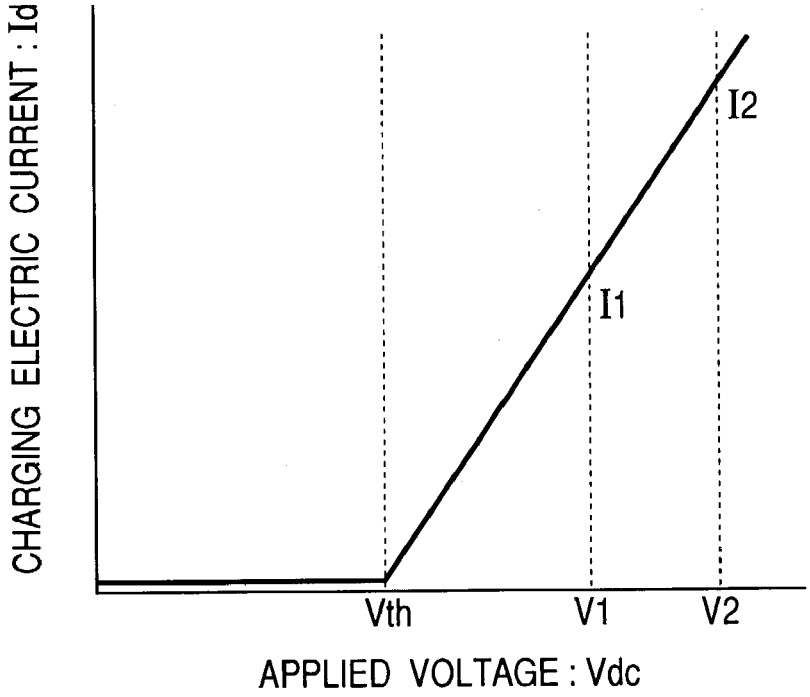
FIG. 6 is a graph explaining a control method of a voltage to be applied to an auxiliary charging roller of a third embodiment.

There is a relation as shown in FIG. 6 between a voltage Vdc applied to the auxiliary charging roller 31 and an electric current Id flowing to the auxiliary charging roller 31. That is, when the voltage Vdc exceeds a discharge threshold value Vth, the electric current Id temporarily changes with respect to the voltage Vdc. Thus, in this embodiment, voltages V1 and V2 sufficiently larger than the discharge threshold value Vth are given, and a linear equation representing a relation between the electric current Id and the voltage Vd is found from electric currents I1 and I2 at that point. A voltage at the time when Id=0 is calculated as Vth' from the equation. A voltage to be applied to the auxiliary charging roller 31 has a value found by adding Vth' to a desired charging potential Vd'. By performing such control, an electric field which is generated between the auxiliary charging roller 31 and the photosensitive drum 1 can be kept constant over a long period and, in the magnetic brush charging device 2 serving as the main-charging means, the conducting magnetic particles on the entire surface of the charging area can be prevented from depositing on the photosensitive drum 1 over a long period.

In addition, the control method is not limited to this. For example, a method may be adopted which applies a very low electric current to the auxiliary charging roller 31 and measures a voltage to be applied to the roller 31 and the photosensitive drum 1 at that point to calculate the voltage as Vth.

(Fourth Embodiment)

The main-charging means 2 is not limited to the magnetic brush charging device as described in the above-mentioned respective embodiments. The contact charging device using conducting particles described in JP 10-307454 A to 10-307459 A can also be used. In this case, the conducting particles can also be prevented from depositing on the photosensitive drum 1.

Figure 7:
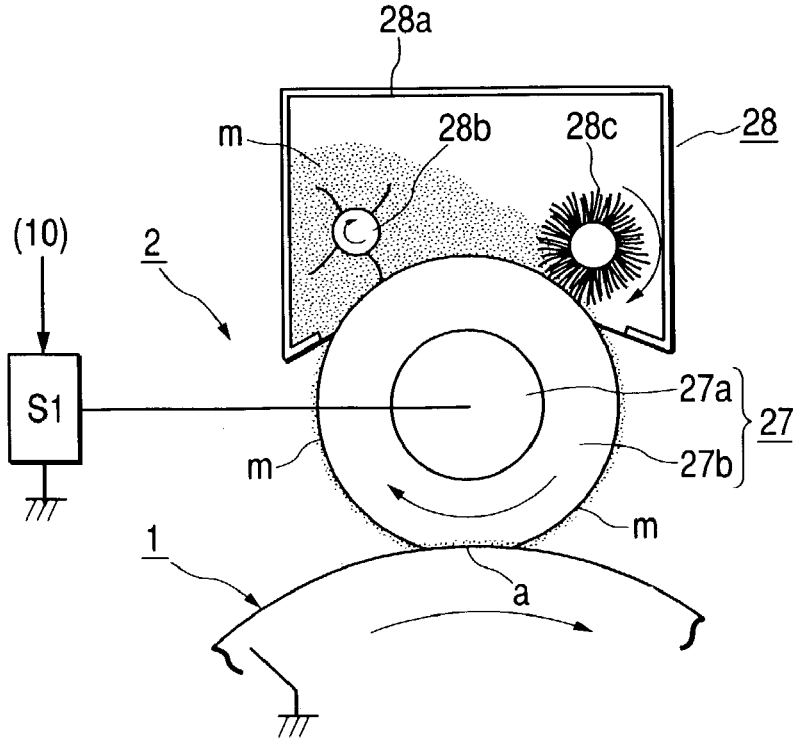
FIG. 7 is a schematic diagram of a charging device serving as main-charging means of a fourth embodiment.

FIG. 7 is a schematic diagram of an example of a charging device 2 of this type. This charging device 2 has a charging roller 27 serving as a contact charging member, a charging bias application power supply S1 for supplying a bias to the charging roller 27, and a conducting particle supplier 28 for supplying conducting particles to the charging roller 27.

This charging roller 27 is structured by a core metal 27*a* and an elastic medium-resistance layer 27*b* made of rubber or a foam (sponge roller) serving as a conducting particle carrier, which is formed in a roller shape concentrically and integrally with an external circumference of this core metal 27*a*. Moreover, conducting particles "m" are carried on an external peripheral surface of this elastic medium-resistance layer 27*b* in the form of a thin layer.

This charging roller 27 is pressed and abutted against the photosensitive drum 1 serving as a member to be charged with a predetermined push-in amount to form a charging contact section (charging area) "a" of a predetermined width. The conducting particles "m" carried on the charging roller 27 come into contact with the surface of the photosensitive drum 1 in the charging contact section "n".

The charging roller 27 is driven to rotate in the clockwise direction of arrow which is the same as the rotating direction of the photosensitive drum 1 and rotates in a direction opposite (counter) to the rotating direction of the photosensitive drum 1 in the charging contact section "a", thereby coming into contact with the surface of the photosensitive drum 1 via the conducting particles "m" with a difference of velocities.

A relative velocity difference of the charging roller 27 with respect to the photosensitive drum 1 is provided by driving to rotate the charging roller 27 in a direction opposite to the rotating direction of the charging roller 2 (along the rotating direction of the photosensitive drum 1) at a different peripheral velocity. However, since chargeability of direct charge injection depends upon a ratio between a peripheral velocity of the photosensitive drum 1 and a peripheral velocity of the charging roller 27, it is more advantageous in terms of number of rotations that the charging roller 27 is driven to rotate in the same direction as the photosensitive drum 1. This structure is also preferable in terms of retentive property of particles.

When the printer is forming an image, a predetermined charging bias is applied to the core metal 27*a* of the charging roller 27 from the charging bias application power supply S1. Consequently, the peripheral surface of the photosensitive drum 1 is subjected to contact charging treatment uniformly to predetermined polarity and potential with a direct charge injection mechanism.

Application of the conducting particles "m" to the charging roller 27 by the conducting particle supplier 28 is carried out by agitating the conducting particles "m", which are stored in a housing container 28*a* of the conducting particle supplier 28, with agitation impellers 28*b* and supplying the particles to the external peripheral surface of the charging roller 27. Then, the charged particles "m", which become excessive depending upon a target amount of application, are removed by a fur brush 28*c*, whereby application of charged particles of a proper amount is carried out. An amount of application of charged particles can be adjusted at any time according to control of the number of rotations of the fur brush 28*c*.

The conducting particles "m" are, for example, conductive zinc oxide with a specific resistance of $10^3$ Ω·cm and an average particle diameter of 1.3 μm. As a material of the conducting particles "m", various conducting particles such as conductive inorganic particles of other metal oxides or the like or a mixture with an organic matter, or those subjected to surface treatment can be used. In addition, since it is not necessary to restrict the conducting particles "m" magnetically, they do not need to have magnetism. As to a particle resistance, since charges are transferred via particles, $10^{12}$ Ω·cm or less is required as a specific resistance, and $10^{10}$ Ω·cm or less is desirable. On the other hand, in the case in which there is a pinhole in a drum, it is desirable that the specific resistance is $10^{-1}$ Ω·cm or more, and preferably $10^2$ Ω·cm or more in order to prevent a mark of leakage from being caused.

(Other Embodiments)

1) The photosensitive drum 1 will be further described briefly. As the photosensitive drum 1 serving as the image bearing member (a member to be charged), an organic photosensitive member or the like, which is usually used, can be used. However, preferably, an organic photosensitive member having a low resistance surface layer thereon or a photosensitive member having a low resistance layer with a surface resistance of $10^9$ to $10^{14}$ Ω·cm such as an amorphous silicon photosensitive member can make the direct charge injection mechanism independent and is effective for prevention of generation of ozone. In addition, it also becomes possible to improve the charging property. In the above-mentioned embodiments, an organic photosensitive member which has conducting particles ($SnO_2$) scattered on a surface thereof as a charge injection layer and has a surface resistance of approximately $10^{13}$ Ω·cm is used.

[Organic photosensitive member]: In recent years, various organic photoconductive materials have been developed as a photoconductive material for an electrophotographic photosensitive member. In particular, a function separation type photosensitive member in which a charge generation layer and a charge transport layer are stacked, have already put to practical use and mounted on a copier or a laser beam printer.

However, these photosensitive members have been considered to have a significant disadvantage in that durability is generally low. The durability is roughly divided into durability in terms of electrophotographic properties such as sensitivity, residual potential, charging ability, and unsharpness of an image and mechanical durability such as abrasion and scratches on a surface of the photosensitive member due to rubbing. Both kinds of durability are significant factors determining a durable life of the photosensitive member.

It is known that the durability in terms of electrophotographic properties is low, in particular, unsharpness of an image is caused because a charge transport material contained in a surface layer of the photosensitive member is deteriorated by an active material such as ozone or NOx generated from a corona charger.

In addition, it is known that the mechanical durability is low because paper, a cleaning member such as a blade or a roller, a toner, or the like physically comes into contact with and rubs against a photoconductive layer.

In order to improve the durability in terms of electrophotographic properties, it is important to use a charge transport material which is hardly deteriorated by an active material such as ozone or NOx, and it is known that a charge transport material with a high oxidation potential is selected. In addition, in order to improve the mechanical durability, it is important to increase lubricity of the surface and reduce friction in order to withstand rubbing by paper or a cleaning member and to improve a releasing property of the surface in order to prevent filming fusing or the like of a toner, and it is known that a lubricant such as fluorine based resin powder particles, fluoric graphite, polyolefine based resin powder, or the like is mixed in a surface layer.

In the case in which direct charge injection is used as a charging system, a surface layer in which conductive particulates are scattered may be provided in order to increase injection efficiency of charges.

[Amorphous silicon based photosensitive member (a-Si)]: In the electrophotography, a photoconductive material forming a photoconductive layer in a photosensitive member is required to have characteristics such as having high sensitivity, high in SN ratio [photocurrent (Ip)/dark current (Id)], having an absorption spectrum suitable for spectral characteristics of an electromagnetic wave to be irradiated, high in optical responsiveness, having a desired dark resistance value, and harmless to a human body when it is used. In particular, in the case of a photosensitive member for an electrophotographic apparatus incorporated in an electrophotographic apparatus which is used in an office as a business machine, taking into account the fact that the photosensitive member is used for copying a large number of sheets over a long period, long-term stability of both image quality and image density is also an important point.

As one of photoconductive materials showing excellent characteristics in such points, there is hydrogenised amorphous silicon (hereinafter referred to as "a-Si:H"). For example, JP 60-35059 B describes an application of a-Si:H as a photosensitive member for an electrophotographic apparatus.

In general, as such a photosensitive member for an electrophotographic apparatus, a conductive support member is heated to 50° C. to 400° C. to form a photoconductive layer composed of a-Si on the support member according to a film forming method such as the vacuum evaporation method, the sputtering method, the ion plating method, the thermal CD method, the optical CD method, or the plasma CD method. Above all, the plasma CD method, that is, a method of dissolving a material gas with a direct current, a high frequency wave, or micro wave glow discharge to form an a-Si deposit film on the support member is put to practical use as a preferable method.

According to these techniques, electrical, optical, and photoconductive characteristics as well as use environment characteristics of the photosensitive member for an electrophotographic apparatus have been improved. With the improvement of these characteristics, an image quality has also been improved.

In addition, an amorphous silicon photosensitive member (photosensitive member composed of a surface layer including amorphous silicon) also shows a satisfactory charging property for the direct charge injection system.

2) A laser beam printer is illustrated as an image forming apparatus in the embodiments. However, it is needless to mention that the present invention is not limited to this but may be applied to other image forming apparatuses such as an electrophotographic copier, a facsimile apparatus, and a word processor or an image display apparatus such as an electronic black board.

3) Exposure means for forming an electrostatic latent image is not limited to the laser scanning exposure means 4 for forming a digital latent image as in the embodiments but may be usual analog image exposure or other light-emitting element such as an LED. Any exposure means, for example, one according to combination of a light-emitting element such as a fluorescent light and a liquid crystal shutter or the like, may be adopted as long as an electrostatic latent image corresponding to image information can be formed.

4) The image bearing member as a member to be charged is an electrostatic recoding dielectric in the case of an electrostatic recording apparatus. In the case of the electrostatic recording dielectric, this is charged uniformly to predetermined polarity and potential by a charging device, and a charging treatment surface thereof is selectively subjected to residual charge eliminating treatment by residual charge eliminating means such as a residual charge eliminating needle array or an electron gun, and an electrostatic image is written and formed on the surface.

5) The image bearing member is not limited to the drum type but may be a belt type with an endless shape or with an end, a sheet type, or the like.

6) A structure of the developing device 5 is not specifically limited either. The developing device 5 may be a regular developing device.

In general, a development method for an electrostatic latent image is roughly divided into the following four types: a method of coating a nonmagnetic toner on a developer carrying member such as a sleeve with a blade or the like or coating a magnetic toner on the developer carrying member with a magnetic force to carry the toner and applying it to an image bearing member in a non-contact state to develop an electrostatic latent image (one component non-contact development); a method of applying the toner coated on the developer carrying member as described above to the image bearing member in a contact state to develop an electrostatic latent image (one component contact development); a method of using a material, in which a magnetic carrier is mixed with toner particles, as a developer (two component developer) to carry the developer with a magnetic force and applying it to an image bearing member in a contact state to develop an electrostatic latent image (two component contact development); and a method of applying the two component developer to the image bearing member in a non-contact state to develop an electrostatic latent image (two component non-contact development).

7) The transfer means is not limited to roller transfer but may be belt transfer, corona transfer, or the like. It may be an image forming apparatus which uses an intermediate transfer member (intermediate transferred member) or the like such as a transfer drum or a transfer belt to form not only a single color image but also a multi-color or full color image according to multiple transfer or the like.

8) Since the direct charge injection adopts direct movement of charges from a contact charging member to a part of a member to be charged as a charging mechanism thereof, the contact charging member is required to be sufficiently in contact with the surface of the member to be charged, and it is desirable to rotate the contact charging member with respect to the member to be charged with a difference of peripheral velocities. More specifically, as the difference of velocities between the contact charging member and the member to be charged, a difference of velocities is provided between a surface of the contact charging member and the member to be charged by driving to move the surface of the contact charging member. Preferably, the contact charging member is driven to rotate and a rotating direction thereof is opposite to the moving direction of a surface of the member to be charged. It is also possible to provide a difference of velocities by moving the surface of the contact charging member in the same direction as the moving direction of the surface of the member to be charged. However, since a charging property of direct charge injection depends upon a ratio of a peripheral velocity of the member to be charged and a peripheral velocity of a contact charging member, in order to obtain the same peripheral velocity ratio as in the opposite direction, the number of rotations of the contact charging member becomes larger in a forward direction than that in the case of the opposite direction. Therefore, it is advantageous in terms of the number of rotations to move the contact charging member in the opposite direction. The peripheral velocity ratio described here is expressed as follows:

Peripheral velocity ratio (%)=(peripheral velocity of contact charging member−peripheral velocity of the member to be charged)/peripheral velocity of the member to be charged×100 (the peripheral velocity of the contact charging member takes a positive value when the surface of the contact charging member moves in the same direction as the surface of the member to be charged in a contact section).

9) It is needless to mention that the charging device of the present invention is not limited to a charging device of an image bearing member (electrophotographic photosensitive member, electrostatic recording dielectric, etc.) of an image forming apparatus but may be effective in being widely used as charging treatment means (including residual charge eliminating treatment) in the member to be charged.

The embodiments of the present invention have been described. The present invention is not limited to these embodiments, and various modifications are possible within the technical idea of the present invention.

What is claimed is:

1. A charging device comprising:

charging means for charging a member to be charged to a set potential, said charging means having a first charger, which charges the member to be charged, and a second charger, which is disposed on a downstream side of said first charger with respect to a rotating direction of the member to be charged, and to which a voltage having the same polarity as said first charger is applied to charge an area charged by said first charger, said second charger bringing a carrying member into contact with the member to be charged to charge the area, said carrying member carrying on a surface thereof magnetic particles having a triboelectrification polarity opposite to a charging polarity of said second charger; and voltage controlling means, which controls a voltage applied to said second charger in such a manner that the voltage applied to said second charger is turned ON before the area charged by said first charger reaches said second charger, and is turned OFF after a posterior end portion of the area charged by said first charger with respect to the rotating direction passes said second charger.

2. A charging device according to claim 1, wherein said second charger holds the magnetic particles with a magnetic force.

3. A charging device according to claim 1, wherein said second charger subjects the member to be charged to charge injection.

4. A charging device according to claim 1, wherein said first charger has a contact charging member which comes into contact with the member to be charged.

5. A charging device according to claim 1, wherein said first charger mainly performs charging according to discharge.

6. An image forming apparatus comprising:

a photosensitive member;

charging means for charging said photosensitive member to a set potential, said charging means having a first charger, which charges said photosensitive member, and a second charger, which is disposed on a downstream side of said first charger with respect to a rotating direction of said photosensitive member, and to which a voltage having the same polarity as said first charger is applied to charge an area charged by said first charger, said second charger bringing a carrying member into contact with said photosensitive member to charge the area, said carrying member carrying on a surface thereof magnetic particles having a triboelectrification polarity opposite to a charging polarity of said second charger;

exposure means which subjects said photosensitive member charged by said charging means to image exposure to form an electrostatic image;

developing means which develops the electrostatic image;

transfer means which transfers a developed image on said photosensitive member to a recording material; and voltage controlling means, which controls a voltage applied to said second charger in such a manner that the voltage applied to said second charger is turned ON before the area charged by said first charger reaches said second charger, and is turned OFF after a posterior end portion of the area charged by said first charger with respect to the rotating direction passes said second charger.

7. An image forming apparatus according to claim 6, wherein said second charger holds the magnetic particles with a magnetic force.

8. An image forming apparatus according to claim 6, wherein said second charger subjects said photosensitive member to charge injection.

9. An image forming apparatus according to claim 6, wherein said first charger has a contact charging member which comes into contact with said photosensitive member.

10. An image forming apparatus according to claim 6, wherein said first charger mainly performs charging according to discharge.

* * * * *